US010434518B2

(12) United States Patent
Jonkka

(10) Patent No.: US 10,434,518 B2
(45) Date of Patent: Oct. 8, 2019

(54) METHOD AND A SYSTEM FOR SUPPORTING A FRAME OF A MINERAL MATERIAL CRUSHER AND A CRUSHING PLANT

(71) Applicant: Metso Minerals, Inc., Helsinki (FI)

(72) Inventor: Jari Jonkka, Kangasala (FI)

(73) Assignee: Metso Minerals, Inc., Helsinki (FI)

( * ) Notice: Subject to any disclaimer, the term of this patent is extended or adjusted under 35 U.S.C. 154(b) by 908 days.

(21) Appl. No.: 14/893,161

(22) PCT Filed: May 26, 2014

(86) PCT No.: PCT/FI2014/050407

§ 371 (c)(1),
(2) Date: Nov. 23, 2015

(87) PCT Pub. No.: WO2014/199004

PCT Pub. Date: Dec. 18, 2014

(65) Prior Publication Data

US 2016/0121338 A1 May 5, 2016

(30) Foreign Application Priority Data

Jun. 14, 2013 (FI) ..... 20135652

(51) Int. Cl.
*B02C 21/02* (2006.01)
*B02C 1/04* (2006.01)
(Continued)

(52) U.S. Cl.
CPC ..... *B02C 21/026* (2013.01); *B02C 1/00* (2013.01); *B02C 1/005* (2013.01); *B02C 1/02* (2013.01);
(Continued)

(58) Field of Classification Search
USPC ..... 241/286
See application file for complete search history.

(56) References Cited

U.S. PATENT DOCUMENTS 3,184,867 A 5/1965 Symmank
2008/0272561 A1* 11/2008 Monk ..... B60G 21/06 280/5.507
2010/0163657 A1* 7/2010 Lehtonen ..... B02C 2/10 241/30

FOREIGN PATENT DOCUMENTS

CN 1681700 A 10/2005
CN 101808849 A 8/2010
(Continued)

OTHER PUBLICATIONS

PCT International Search Report and Written Opinion dated Sep. 30, 2014.
(Continued)

*Primary Examiner* — Shelley M Self
*Assistant Examiner* — Jared O Brown
(74) *Attorney, Agent, or Firm* — Andrus Intellectual Property Law, LLP

(57) ABSTRACT

A method and a system for supporting a frame of a mineral material crusher on a body of a crushing plant and a mineral material processing plant. The crusher frame is supported by first support devices in place in relation to the body of the crushing plant at first support points and by at least two second support devices at second support points. The second support device has an adjusting member between the crusher frame and the body of the crushing plant, and at least one second support device is configured to move the frame of the crusher vertically in relation to the body of the crushing plant. The adjusting member has a cylinder and a piston inside the cylinder which define an adjusting volume therebetween. A pressure is formed from a load above the adjusting member and is arranged to form into the adjusting volumes of the adjusting members.

19 Claims, 5 Drawing Sheets

(51) Int. Cl.

| | |
|---|---|
| ***B02C 1/06*** | (2006.01) |
| ***B02C 1/00*** | (2006.01) |
| ***B02C 1/02*** | (2006.01) |
| ***B02C 23/00*** | (2006.01) |

(52) U.S. Cl.
CPC ..... *B02C 1/043* (2013.01); *B02C 1/06* (2013.01); *B02C 23/00* (2013.01)

(56) References Cited

FOREIGN PATENT DOCUMENTS

| | | | | | |
|---|---|---|---|---|---|
| CN | 101829612 | A | * | 9/2010 | |
| CN | 201959856 | U | | 9/2011 | |
| CN | 102529712 | A | | 7/2012 | |
| CN | 102770606 | A | | 11/2012 | |
| DE | 195 37 592 | A1 | | 3/1997 | |
| DE | 19537592 | A1 | * | 3/1997 | ..... B02C 1/02 |
| DE | 203 02 870 | U1 | | 7/2004 | |
| WO | 2009077640 | A1 | | 6/2009 | |
| WO | 2013004889 | A1 | | 1/2013 | |
| WO | 2013073415 | A1 | | 5/2013 | |

OTHER PUBLICATIONS

Fl Search Report dated Mar. 27, 2014.
Chinese Search Report for Chinese Application No. 201480033931.X dated Dec. 22, 2016.

* cited by examiner

METHOD AND A SYSTEM FOR SUPPORTING A FRAME OF A MINERAL MATERIAL CRUSHER AND A CRUSHING PLANT

CROSS-REFERENCE TO RELATED APPLICATIONS

This application claims priority to PCT/FI2014/050407, filed May 26, 2014, and published in English on Dec. 18, 2014 as publication number WO 2014/199004, which claims priority to FI Application No. 20135652, filed Jun. 14, 2013, incorporated herein by reference.

TECHNICAL FIELD

The invention relates generally to supporting a frame of a mineral material crusher on a base. The invention relates particularly, though not exclusively, to preventing twisting of a frame of a jaw crusher.

BACKGROUND ART

Mineral material, for example rock, is gained from the earth for processing by exploding or excavating. The rock can also be natural rock and gravel or construction waste. Mobile crushers and stationary crushing applications are used in crushing. An excavator or wheeled loader loads the material to be crushed into the crusher's feed hopper from where the material to be crushed may fall in a crushing chamber of a crusher or a feeder moves the rock material towards the crusher. The mineral material to be crushed may also be recyclable material such as concrete, bricks, or asphalt.

Jaw crushers are suitable for example to coarse crushing at quarries or crushing of construction material. According to the function principle of the jaw crusher the crushing takes place against jaws, the so called fixed and movable jaws.

WO 2013/004889 A1 shows a known jaw crusher 100 according to FIG. 1. The frame 10 of the jaw crusher is formed of a front end 101 and a rear end 101' and side plates. A fixed jaw 102 receiving the crushing forces is fixed to the front end of the jaw crusher. A movable jaw 103 is fixed to a pitman, an eccentric movement of the movable jaw being generated by rotating an eccentric shaft. The jaw crusher comprises further a pulley 104, V-belts 107, a motor 105 and a motor pulley 106 to move the movable jaw 103. The rock material is crushed between the jaws and proceeds after the crushing to further processing for example along a belt conveyor. The crusher further comprises fixing devices 210, 220 to fix the crusher 100 to body structures 121 of a processing plant.

Sandwich type rubber dampers are fixed to the body structures the rubber damper being fixed between two steel plates. The fixing devices 210 of the front end 101 of the jaw crusher are fixed to the sandwich type rubber dampers, and the fixing devices 220 of the rear end rest on the rubber dampers with a friction joint. Only the front end fixing devices 210 are fixed in place to the body structures 121 of the processing plant holding the crusher in place. The friction joint of the rear end 101' allows the frame of the crusher move if necessary, if a flexibility reserve of the front and rear ends comes to an end in some cases.

The crushing forces and the material dropping into the throat of the crusher cause loads in the crusher, the loads spreading through the crusher frame to the surrounding structures. The dropping of a large stone arriving into the throat and the crushing of the stone causes large forces in the machine direction.

In case of a movable processing plant, particularly equipped with a track base, the fixing devices are subjected to even larger stresses. For example when a crushing plant moves on an uneven terrain the known fixing method causes forces which stress the frame structures of the crusher. The crushing plant may be in a so called cross hanging because of the unevenness of the terrain wherein the body of the crushing plant twists downwards at crosswise located corners. In that situation the fixing devices in said corners are subjected to large vertical stresses which also can lead to breaking of for example bolts, rubber dampers, or welding seams of the supports.

A vertical flexibility of the existing fixing method is small. The fixing method requires straightness and rigidity that the frame of the crusher would not twist according to the base. The twisting of the crusher frame causes misalignment between the pitman and the frame which shortens life of the toggle plate and bearings of the jaw crusher. The accuracy required of the body of the processing plant increases manufacturing costs. Additionally, for example the body of a mobile crushing plant must be positioned precisely before the crushing.

FIG. 2*a* shows a situation of the rear supports 220 of the jaw crusher when the base 121 of the crusher is straight. An equal force F/2 is directed to both rear supports so that the frame 10 of the crusher is not subjected to any twisting force. FIG. 2*b* shows the situation of the rear supports 220 of the jaw crusher when an error of the base is s. Then a force ¾ F is directed to a first rear support and a force ¼ F is directed to a second rear support, and the frame 10 of the crusher is subjected to a twisting force. FIG. 2*c* shows a problematic situation of the rear supports 220 of the jaw crusher when the error of the base exceeds the twisting of the crusher frame 10 being 2*s*. A force F is directed to the first rear support 220, the force directed to the second rear support is zero, and the second rear support is off the base and does not support the crusher. In that situation the crusher frame 10 is subjected to a maximum twisting force. The situations shown in FIGS. 2*b* and 2*c* are undesired in view of the crusher operation.

An object of the invention is to avoid problems present in connection with prior art and/or provide new technical alternatives.

SUMMARY

According to a first example aspect of the invention there is provided a method according to claim 1.

According to an example aspect there is provided a method for supporting a frame of a mineral material crusher on a base, in which method the frame is supported by first support devices in place in relation to the base at first support points of the base and the frame is supported by at least two second support devices to the base at second support points which second support points are located at a distance from the first support points, and the second support device comprises an adjusting member to be arranged in between the frame and the base, and moving at least by one second support device the frame of the crusher vertically in relation to the base.

Preferably arranging two second support devices at a distance from each other in a side direction of the crusher frame and moving a side of the crusher frame located in a first side direction vertically in relation to the base by one second support device.

Preferably moving a side of the crusher frame located in a second side direction vertically in relation to the base by a second support device.

Preferably the adjusting member comprises a cylinder and a piston adapted inside the cylinder which define an adjusting volume therebetween in which a pressure is formed from a load above the adjusting member.

Preferably the method comprising connecting the adjusting volumes of said at least two second support devices to each other by one or more hydraulic channels so that a hydraulic liquid in said adjusting volumes is allowed to flow to other adjusting volumes connected by hydraulic channels to equalize the pressure in said adjusting volumes.

Preferably the method comprising connecting the adjusting volumes of said at least two second support devices to each other by hydraulic channels which are connected at a first end to the adjusting volume of said adjusting members and at a second end to a pressure accumulator. Preferably detecting the pressures in the adjusting volumes and controlling based on the detected pressure a desired pressure from the pressure accumulator to the adjusting volume. Preferably detecting a vertical ratio of the frame and the base and controlling based on the detected ratio a desired volume and pressure from the pressure accumulator to the adjusting volume wherein the adjusting member contracts or expands to adjust the desired height position of the frame.

Preferably fixing the first support device to the front end of the frame and the second support device to the rear end of the frame.

Preferably supporting the frame by the first support devices in place inclinably in relation to the base.

Preferably the base is a body of a mineral material processing plant.

Preferably arranging the second support device to rest with a friction joint on the base.

Preferably when a vertical error is forming to the straightness of the base, hydraulic liquid flows from the first adjusting volume of the first adjusting member through the hydraulic channel to the second adjusting volume of the second adjusting member so that said first adjusting member contracts and said second adjusting member expands.

Preferably when the straightness of the base is changing, a same pressure is formed to all adjusting volumes connected by the hydraulic channels by allowing hydraulic liquid to flow through the hydraulic channel between said adjusting volumes.

Preferably forming an equal support force to the second support devices arranged to the rear end of the frame.

According to a second example aspect of the invention there is provided a system according to claim 14.

According to an example aspect there is provided a system for supporting a frame of a mineral material crusher on a base, which system comprises the crusher, the base, first support devices by which the crusher frame is supported in place to the base at first support points, and at least two second support devices by which the frame is supported on the base at second support points which are located at a distance from the first support points, and the second support device comprises an adjusting member which is arranged in between the frame and the base, and at least one second support device is configured to move the frame of the crusher vertically in relation to the base.

Preferably the adjusting member comprises a cylinder and a piston adapted inside the cylinder which define an adjusting volume therebetween.

Preferably the system comprises one or more hydraulic channels which is/are connected to the adjusting volumes of said at least two second support devices so that a hydraulic liquid in said adjusting volumes is allowed to flow to other adjusting volumes connected by hydraulic channels to equalize the pressure in said adjusting volumes.

Preferably the system comprises a pressure accumulator; and hydraulic channels which are connected at a first end to the adjusting volume of said adjusting members of the second support devices and at a second end to the pressure accumulator.

Preferably the first support device is fixed to the front end of the frame and the second support device to the rear end of the frame.

Preferably the base is a body of a mineral material processing plant.

Preferably the second support device is arranged to rest with a friction joint on the base.

Preferably when a vertical error is forming to the straightness of the base, the system is configured so that hydraulic liquid flows from the first adjusting volume of the first adjusting member through the hydraulic channel to the second adjusting volume of the second adjusting member wherein said first adjusting member contracts and said second adjusting member expands.

Preferably in the system hydraulic liquid is allowed to flow through the hydraulic channel between all adjusting volumes connected by the hydraulic channels wherein when the straightness of the base is changing a same pressure is formed to said adjusting volumes.

Preferably in the system hydraulic liquid is allowed to flow through the hydraulic channel between all adjusting volumes connected by the hydraulic channels wherein when the straightness of the base is changing an equal support force is formed to the second support devices arranged to the rear end of the frame.

Preferably the piston is fixed at the frame side and the cylinder is fixed at the base side.

Preferably the piston is fixed at the base side and the cylinder is fixed at the frame side.

Preferably the crusher is one of the following: a jaw crusher, a horizontal shaft impactor, a vertical shaft impactor, a gyratory crusher, a cone crusher.

According to a third aspect of the invention there is provided a mineral material processing plant comprising a system according to the second aspect of the invention.

Preferably the mineral material processing plant is a movable processing plant.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying drawings.

DETAILED DESCRIPTION

In the following description, like numbers denote like elements. It should be appreciated that the illustrated drawings are not entirely in scale, and that the drawings mainly serve the purpose of illustrating some example embodiments of the invention.

Figure 1:
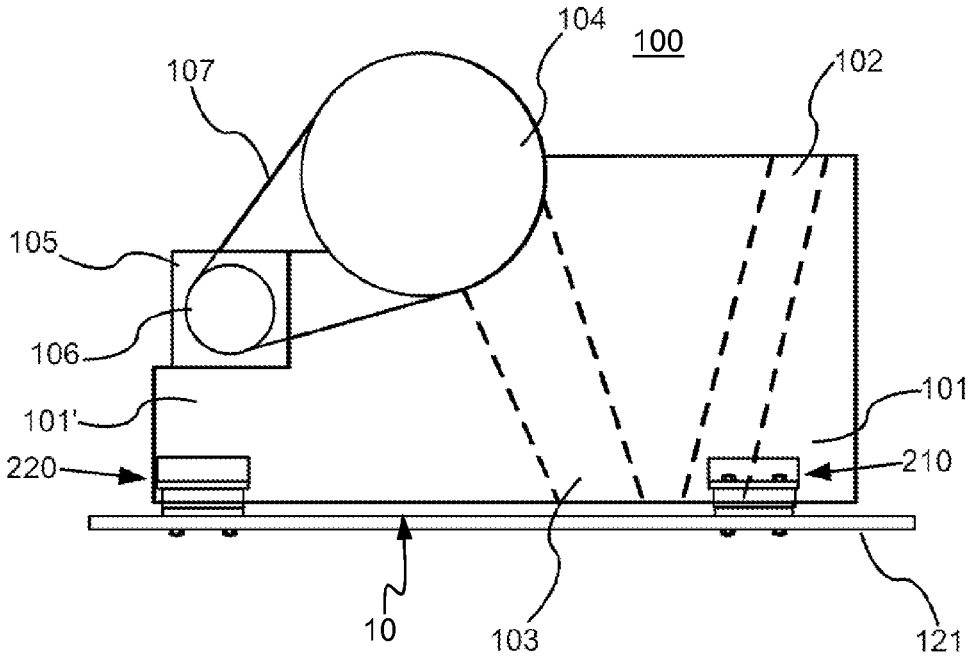
FIG. 1 shows a known jaw crusher.
Figure 2A:
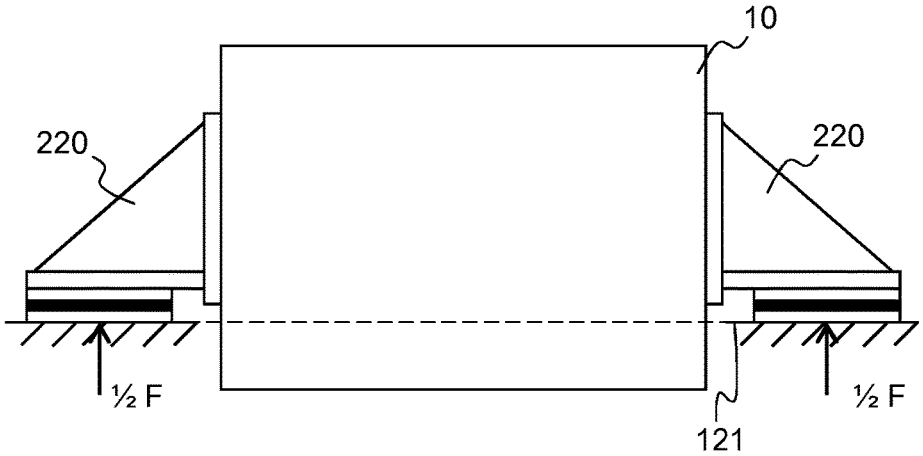
FIG. 2*a* shows forces acting to rear supports of the known jaw crusher when a base of the crusher is straight.
Figure 2B:
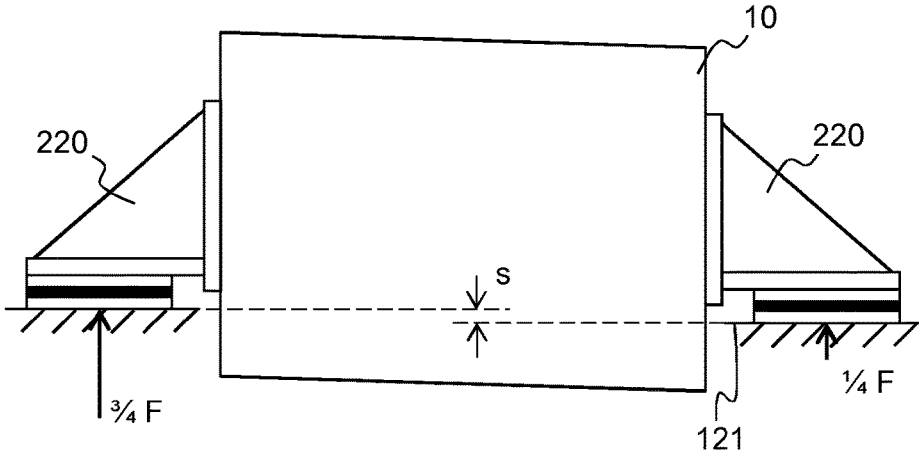
FIG. 2*b* shows forces directed to the rear supports of FIG. 2*a* when an error of the base of the crusher is s.
Figure 2C:
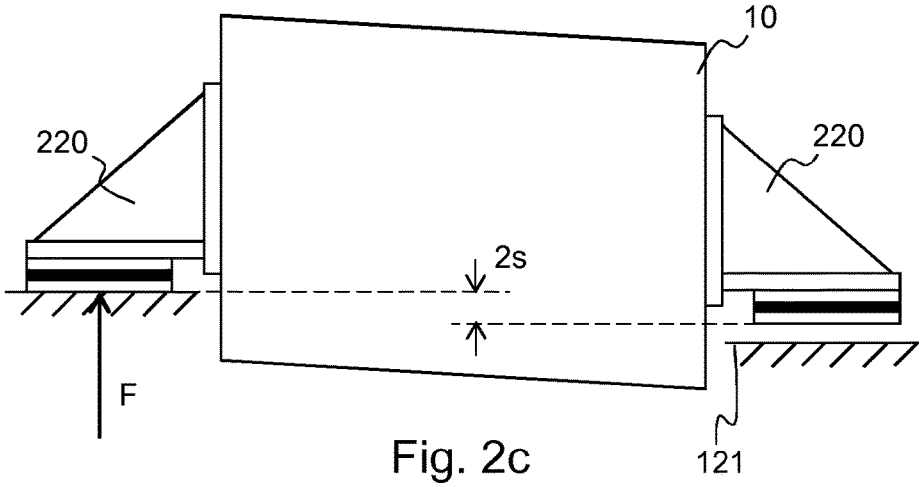
FIG. 2*c* shows forces directed to the rear supports of FIG. 2*a* when an error 2*s* of the base of the crusher exceeds a twisting of the crusher frame.

FIGS. 1 to 2*c* are described in connection with the prior art. The inventor has found that the undesired twisting of the crusher frame can be reduced with a simple and cost effective solution. The crusher according to FIG. 1 can also be used as operation object of embodiments of the present invention so that instead of the support devices of FIGS. 1 and 2 a support device according to an embodiment of the invention is used, for example the second support device shown in FIGS. 3*a*-3*c*, 4 or 5. With help of different embodiments of the invention all support devices can bear load without crusher frame twisting.

Figure 3A:
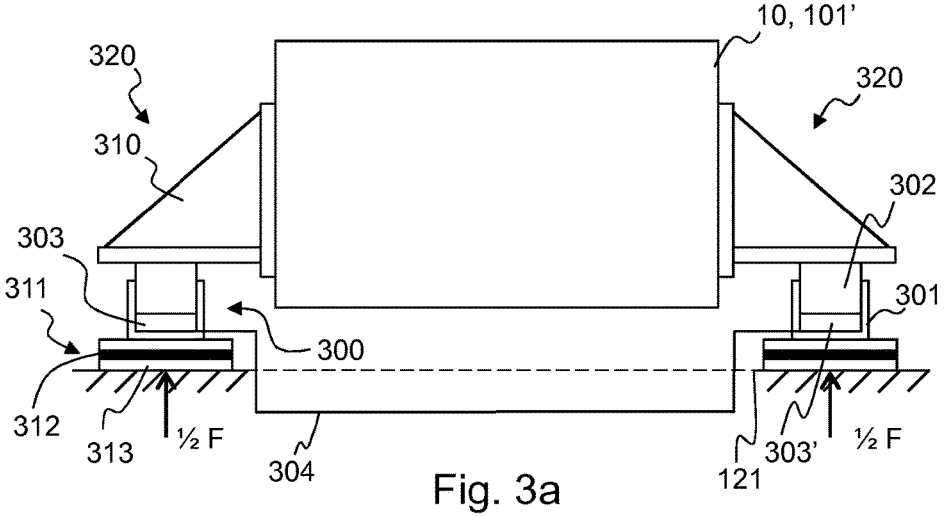
FIGS. 3*a*-3*c* show functions of support devices according to the invention when the crusher base has different errors.
Figure 3B:
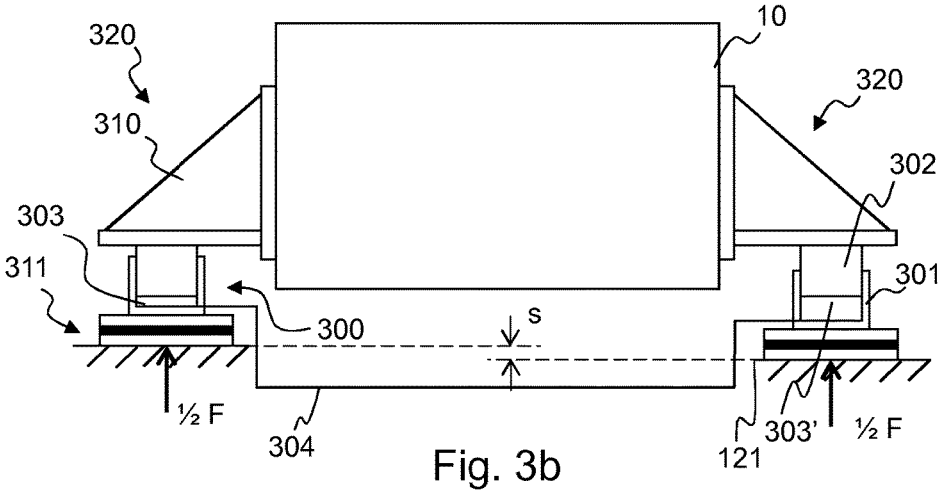
Figure 3C:
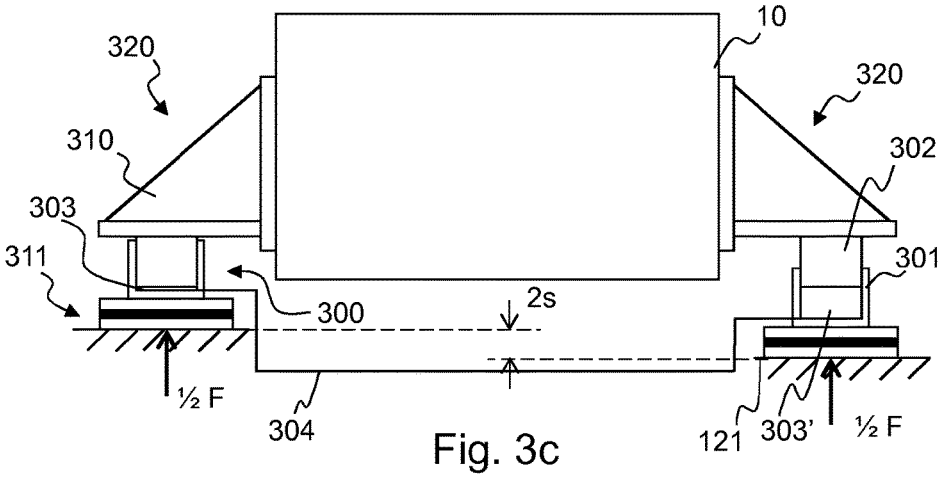

Support devices according to different embodiments of the invention are shown in FIGS. 3*a*-3*c*, 4 and 5. FIGS. 3*a*-3*c* show functions of second support devices according to the invention when the base of the crusher 121 for example a body 701 of a crushing plant 700 has different errors.

The second support device 320 comprises a fixing part 310 to be fixed to the frame 10 of the crusher, preferably to a rear end 101' of the frame, a bottom part 311 to be supported against the base 121 for example a body 701 of a crushing plant 700 (shown in FIG. 7), and an adjusting member 300 between the fixing part and the bottom part. The bottom part 311 comprises a preferably sandwich-type damper in which an elastic damping material 312 such as rubber is fixed in between two steel plates 313. In an embodiment the bottom part 311 is not fixed stationary to the base 121 but the second support devices 320 rest with a friction joint on the base. Alternatively the bottom part 311 is fixed stationary to the base 121, and the support devices 320 rest with a friction joint on the bottom part 311.

The adjusting member 300 is formed of a hydraulic cylinder which comprises a cylinder 301 and a piston 302 which is adapted to move inside the cylinder. In FIGS. 3*a*-3*c* the piston 302 is fixed at a side of the crusher frame to the fixing part 310 and the cylinder 301 is fixed at a side of the base 121 to the bottom part 311. The cylinder and the piston define an adjusting volume 303, 303' therebetween. The adjusting members 300 of two second support devices 320 are connected to each other in FIGS. 3*a*-3*c*. The connection is implemented by connecting a first adjusting volume 303 of the first adjusting member to a second adjusting volume 303' of the second adjusting member by a hydraulic channel 304 such as a hydraulic pipe or hose. The hydraulic channel 304 allows hydraulic liquid in the first adjusting volume 303 to flow to the second adjusting volume 303' when the first adjusting member contracts, wherein the second adjusting member expands. When the straightness of the base 121 changes the force directed to the second support device 320 keeps same at both sides of the frame in the lateral direction of the frame and the twisting of the frame is eliminated when there is same pressure in the adjusting volumes of both adjusting members 300. The number of second support devices 320 connected to each other may also be different from two, for example three, four, five, six or more and the number is not intended in any way to be invention limiting. The frame 10 of the crusher is preferably fixed at the front end to the base for example in a known way. Alternatively a pivot may exist in the front end in order to enable a sufficient inclination for example between the support damper and the frame. A large shock-like stress is directed to the front end 101 when feeding the material to be crushed.

There may be for example one, two, three, four, five, six or more first support devices mounted between the base (for example the body 701 of the crushing plant 700) and the frame of the crusher and the number is not intended in any way to be invention limiting. The crusher frame may be supported by one first support device and two second support devices wherein there is formed a support with three support points.

FIG. 3*a* shows a situation of the rear supports 320 of a jaw crusher when the base 121 of the crusher is straight. An equal force F/2 is directed to both rear supports so that the frame 10 of the crusher is not subjected to any twisting force.

FIG. 3*b* shows the situation of the rear supports 320 of the jaw crusher when the error of the base is changed to s. Then, hydraulic oil flows from the first adjusting volume 303 to the second adjusting volume 303' until there is same pressure in both cylinders. An equal force F/2 is directed to both rear supports and the crusher frame 10 keeps straight because no twisting force is directed to the frame.

FIG. 3*c* shows the situation of the rear supports 320 of the jaw crusher when the error of the base 121 is changed to 2*s*. Then, hydraulic oil flows from the first adjusting volume 303 to the second adjusting volume 303' until there is same pressure in both cylinders. An equal force F/2 is directed to both rear supports and the crusher frame 10 keeps straight because no twisting force is directed to the frame.

One can notice from FIGS. 3*a*-3*c* that in the solution of the invention the same constant force is directed to the support devices in straightness error situations of the base without influencing the dynamic of the process device. The constant force enhances notably the life of the fixing parts and the dampers in the support device.

Figure 4:
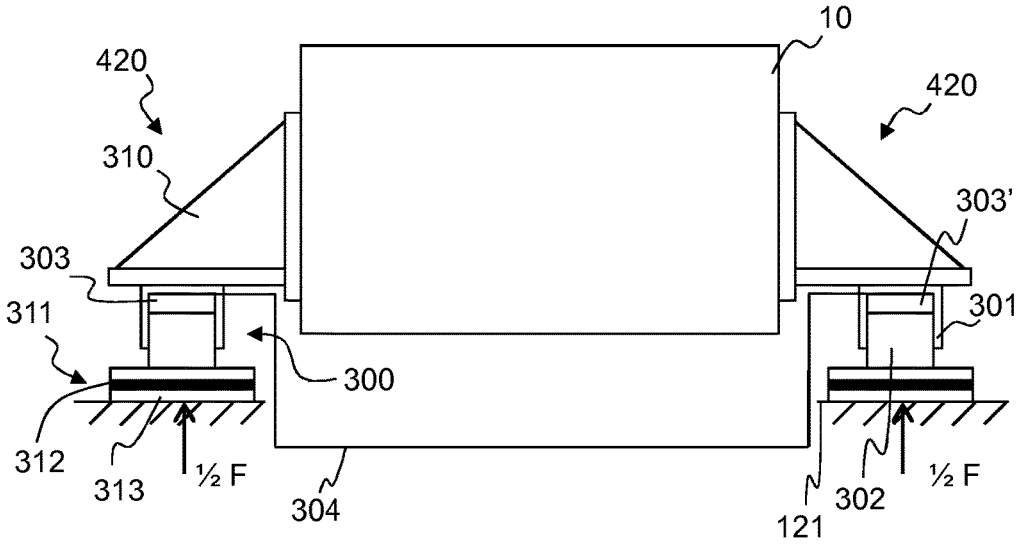
FIG. 4 shows a support device according to the invention.

The crusher frame support solution shown in FIG. 4 corresponds functionally to the solution shown in FIGS. 3*a*-3*c* but the hydraulic adjusting members 300 are rotated upside down in the support devices 420. The cylinder 301 is fixed at the crusher frame side to the fixing part 310 and the piston 302 is fixed at the base side to the bottom part 311. Naturally, in connection with the same crusher frame 10 adjusting members 320, 420 located on either side can be applied having adjusting volumes connected to each other. The hydraulic liquid can be coupled to the adjusting volume also through the piston.

Figure 5:
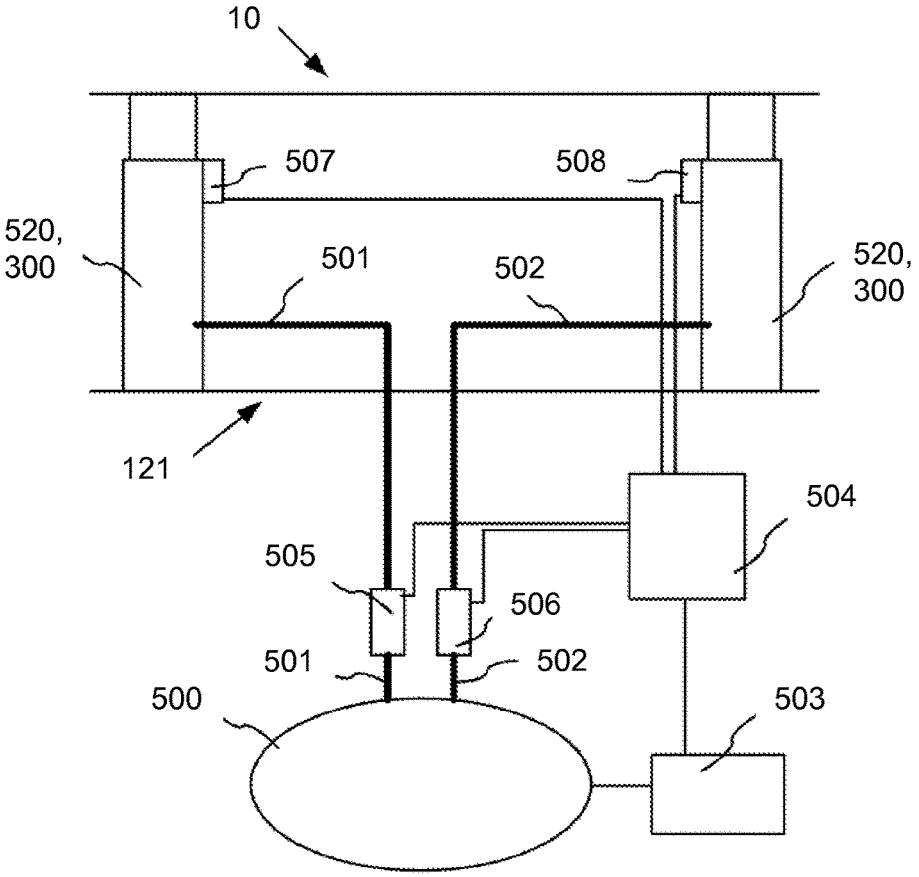
FIG. 5 shows a system according to an embodiment of the invention where the crusher frame can be adjusted vertically relative to the base by the support devices.

FIG. 5 shows a system and a method where the frame 10 of the crusher is vertically adjustable in relation to the base 121 by second support devices 520. The frame 10 is supported by first support devices (FIG. 1, referral sign 210) in place in relation to the base at first support points and in FIG. 5 the frame 10 is additionally supported by two second support devices 520 to the base at second support points which are at a distance from the first support points. Each second support device 520 comprises an adjusting member 300 to be arranged between the frame 10 and the base 121, and the crusher frame is moved vertically in relation to the base by at least one second support device 520.

In the system of FIG. 5 the first support devices and the adjusting members 300 can be fixed in the same way to the frame of the crusher and supported on the base as described in connection with FIGS. 3*a*-3*c* or 4.

The adjusting member 300 is formed of a hydraulic cylinder which comprises a cylinder and a piston adapted to move inside the cylinder. The adjusting member may also an adjusting device acting in another way than hydraulically, for example a mechanically or electromechanically acting adjusting device. The adjusting device may comprise two wedges to be moved relative to each other, of which wedges at least one is moved by a hydraulic, mechanical or electromechanical actuator or any combination of said actuators.

The adjusting members 300 of two support devices 520 are connected in the system of FIG. 5 to a pressure accumulator 500. The first adjusting volume of the first adjusting member is coupled to the pressure accumulator by a first hydraulic channel 501 and a second adjusting volume of the second adjusting member is coupled to the pressure accumulator by a second hydraulic channel 502. Preferably the volume of the pressure accumulator is selected so that the pressure of the pressure accumulator and said cylinder volumes keeps almost same when hydraulic liquid flows from the first adjusting member to the pressure accumulator and/or hydraulic liquid flows from the pressure accumulator to the second adjusting member. The system comprises a pump 503 by which the pressure can be adjusted in the pressure accumulator and, if necessary, increase/reduce the amount of hydraulic liquid in the pressure accumulator. The system comprises a control unit 504. The system comprises a first valve 505 in the first hydraulic channel 501 by which the flow in the first hydraulic channel can be adjusted (e.g. close or throttle the flow). The system comprises a second valve 506 in the second hydraulic channel 502 by which the flow in the second hydraulic channel can be adjusted (e.g. close or throttle the flow). The system comprises in the first adjusting member a first measuring device 507 by which the pressure in the first adjusting volume can be detected. The system comprises in the second adjusting member a second measuring device 508 by which the pressure in the second adjusting volume can be detected. The control unit 504 is coupled to the first and the second measuring devices 507, 508 to receive the pressure information from the first and second adjusting members. The control unit is coupled to the first and second valves 505, 506 to control said valves based on the detected pressure information. The control unit 504 is coupled to the pump 503 to adjust the pressure of the pressure accumulator based on the detected pressure information. In FIG. 5 the system comprises two adjusting members but according to the invention the system may as well comprise more adjusting members, for example three or four or five or six or more. By the system the hydraulic liquid in the adjusting volumes of the adjusting members can be allowed to flow to other adjusting volumes equipped with a hydraulic channel to equalize the pressure in said adjusting volumes. When the straightness of the base 121 changes the force directed to the support devices 520 is configured to keep same and the twisting of the frame 10 is eliminated when same pressure is controlled 504 to the adjusting volumes of all adjusting members 300.

According to a preferable embodiment of the invention a relationship of the frame 10 to the base 121 can additionally be detected by the first measuring device 507 and the second measuring device 508 in the system of FIG. 5, e.g. the distance of the frame relative to the base can be measured. Thus, the adjustment of the distance between the frame and the base is possible when the length of the adjusting members is increased or decreased. The length of the adjusting member increases when hydraulic liquid is added to the adjusting volume. The distance of the rear end 101' of the frame 10, supported by the adjusting members, from the base increases when sufficiently hydraulic liquid is added to all adjusting members. When the pressure of all adjusting volumes is controlled simultaneously same the twisting of the frame 10 is eliminated. Preferably when increasing the height (of the rear end) of the frame the control unit controls the valves 505, 506 to open and to allow hydraulic liquid from the pressure accumulator 500 via the hydraulic channels 501, 502 to the adjusting volumes of the adjusting members 300 until there is a desired, preferably the same, pressure in all adjusting volumes. If necessary pressure/hydraulic liquid is added to the pressure accumulator. Preferably when decreasing the height the control unit controls the valves 505, 506 to open and to allow hydraulic liquid from the adjusting volumes of the adjusting members 300 via the hydraulic channels 501, 502 to the pressure accumulator 500, from where pressure/hydraulic liquid is relieved with e.g. the pump. The height adjustment is stopped when the desired height is detected by the measuring device 507, 508.

Figure 6A:
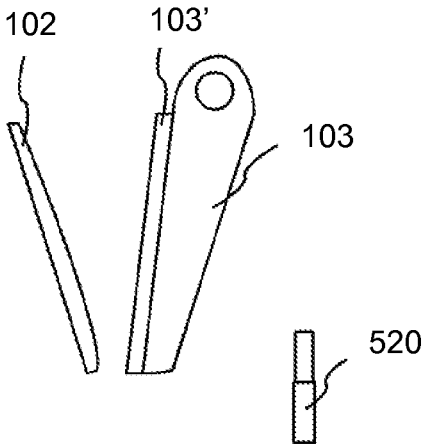
FIG. 6*a* shows a jaw crusher in a first position, the rear end of the jaw crusher being height adjustable according to a method according to an embodiment of the invention.

FIG. 6*a* shows in a first position a jaw crusher which comprises a fixed jaw 102, a movable jaw 103 and a wear part 103' fixed to the movable jaw. The rear end of the jaw crusher is arranged height-adjustable by the system shown in FIG. 5 of which system is presented the height-adjustable support device 520. In the first position the jaw crusher is controlled to an operation position in which the crushing normally takes place. Then a wear surface located at a lower portion of the fixed jaw is in a vertical position, and the crushed material is allowed to exit without hindrance from the crushing chamber.

Figure 6B:
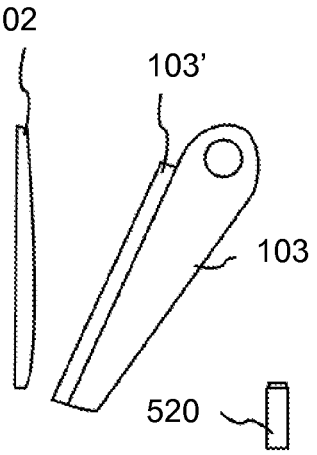
FIG. 6*b* shows the jaw crusher of FIG. 6*a* in a second position.

FIG. 6*b* shows the jaw crusher of FIG. 6*a* in a second position in which the rear end of the crusher is lowered among others to facilitate maintenance and transportation. In the second position (maintenance and transportation position) the distance between the support points of the crusher frame and the base is decreased by the second support devices 520 wherein the uppermost point of the crusher, an upper end of the movable jaw, is descended lower than the first position (operation position).

One can notice as advantages from the height-adjustability of the frame that the position of the crushing chamber of the crusher can be optimized, in other words the crushing event can be fine-tuned. On the other hand replacing of the wear part 103' fixed to the movable jaw of the jaw crusher is facilitated in the second position. The wear part can be lifted from place and mounted in place better when the position of the movable jaw is inclined.

Additionally the second position facilitates design of the crusher because the height of the crusher can in some cases be reduced. Further the transportations of the movable crushing plant 700 and the crusher are enabled easier because of the construction being lower than previously. A maximum height allowed in traffic can be passed under easier than in the prior art.

The invention is described hereinbefore in connection with the jaw crusher but the crusher may also be a crusher of another type for example a horizontal shaft impactor (HSI), a vertical shaft impactor (VSI), a gyratory crusher, a cone crusher. A lid of a horizontal shaft impactor is nicely made open and close when the frame of the impactor is kept non-twisting by the supporting method according to the invention. Said crushers for example the gyratory and the cone crusher and the vertical shaft impactor can be adjusted to an optimal crushing position to compensate an inclination resulting to the base from the unevenness of the terrain. By the gyratory crusher is meant a crusher in which a shaft of an inner crushing blade is supported at both ends to the frame of the crusher, and by the cone crusher is meant a crusher in which the shaft of the inner crushing blade is adapted at a lower end non-movable to the frame of the crusher. The support can also be applied in supporting of a power source and a control unit 705 (a motor module) of a crusher.

Figure 7:
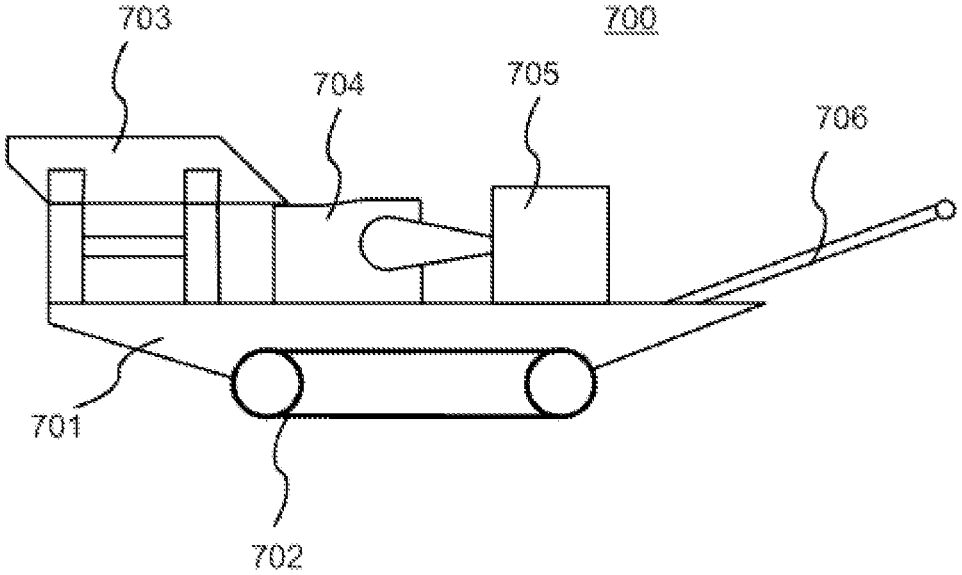
FIG. 7 shows a mineral material processing plant according to the invention.

FIG. 7 shows a movable mineral material processing plant 700 having a feeder 703 for feeding material to a crusher 704 such as the jaw crusher 100 or a horizontal shaft impactor or another type mineral material crusher, and a belt conveyor 706 for conveying crushed material farther from the processing plant. The crusher shown in the figures is preferably a jaw crusher comprising an apparatus according to an embodiment of the invention for reducing the twisting of a pitman. The processing plant 700 comprises also a power source and a control unit 705. The power source may be for example a diesel or an electric motor providing energy for operation of process units and hydraulic circuits.

The feeder, the crusher, the power source and the conveyor are fixed to a frame 701 comprising in this embodiment additionally a track base 702 to move the processing plant. The processing plant may also be entirely or partly wheel based or movable on legs. Alternatively it may be movable/towable e.g. by a truck or another external power source. Additionally to the previously presented the processing plant may also be a stationary processing plant.

Without in any way limiting the scope of protection, understanding or possible applications of the invention, as technical advantages of different embodiments of the invention can be held that the efficiency of the mineral material processing plant and the crusher increases and that energy consumption decreases. Further as a technical advantage of different embodiments of the invention can be held a prolongation of operation time of components of the mineral material crusher for example support devices and elastic damping materials. The durability of the mechanical components increases because the operated crusher is kept straight. Among others, the toggle plate of the jaw crusher keeps straight and does not shape one-sidedly wherein the crushing force is divided evenly towards the bearings and pitman of a pitman assembly. Additionally the straight toggle plate does not move in lateral direction causing added wear to the toggle plate and other components. Further as a technical advantage of different embodiments of the invention can be held increasing of the environmental friendliness of the mineral material processing plant. Further as a technical advantage of different embodiments of the invention can be held decreasing of the manufacturing costs of the mineral material processing plant. The body of a mobile plant can be designed and manufactured lighter and more flexible than previously. The manufacturing precision of the body of the mobile plant can be lower and the body is not always required to be positioned before the crushing what is adding usability. Further as a technical advantage of different embodiments of the invention can be held increasing of the operational reliability of the mineral material processing plant.

The foregoing description provides non-limiting examples of some embodiments of the invention. It is clear to a person skilled in the art that the invention is not restricted to details presented, but that the invention can be implemented in other equivalent means.

Some of the features of the above-disclosed embodiments may be used to advantage without the use of other features. As such, the foregoing description shall be considered as merely illustrative of principles of the invention, and not in limitation thereof. Hence, the scope of the invention is only restricted by the appended patent claims.

The invention claimed is:

1. A method for supporting a frame of a mineral material crusher on a body of a crushing plant, the method comprising:

supporting the frame of the crusher on the body of the crushing plant at two first support points with two first support devices;

supporting the frame of the crusher is on the body of the crushing plant at two second support points with two second support devices, wherein the second support points are located a distance from the first support points; and performing adjustments to vertical position of the second support points relative to each other with an adjusting member of each of the second support devices to thereby reduce undesired twisting in the frame of the crusher;

wherein each adjusting member comprises a cylinder and a piston adapted inside the cylinder, a mechanically acting adjusting member, or an electromechanically acting adjusting member.

2. The method according to the claim 1, wherein the piston and the cylinder of each adjusting member define an adjusting volume therebetween in which a pressure is formed from a load acting on the adjusting member.

3. The method according to claim 2, wherein each adjusting member of the second support devices supports the frame of the crusher.

4. The method according to claim 2, further comprising:

connecting the adjusting volumes to each other with a hydraulic channel configured to permit hydraulic liquid to flow between the adjusting volumes and thereby equalize the pressure in the adjusting volumes.

5. The method according to claim 4, wherein the hydraulic channel is a first hydraulic channel, and further comprising:

connecting the adjusting volumes to each other with the first hydraulic channel having a first end connected to one of the adjusting volumes and a second end connected to a pressure accumulator and a second hydraulic channel having a first end connected to the other of the adjusting volumes and a second end connected to the pressure accumulator.

6. The method according to claim 5, further comprising:

detecting pressure in each of the adjusting volumes, and controlling, based on the detected pressures, the pressure accumulator to thereby adjust the pressure in each of the adjusting volumes to a desired pressure.

7. The method according to claim 5, further comprising:

detecting a vertical ratio of the frame of the crusher and the body of the crushing plant and controlling, based on the vertical ratio, the pressure accumulator to thereby adjust each of the adjusting volumes to a desired volume and pressure, wherein each adjusting member contracts or expands to adjust a vertical height position of the frame of the crusher relative to the body of the crushing plant at the second support points.

8. The method according to claim 1, wherein the first support devices inclinably support the crusher frame in relation to the body of the crushing plant.

9. A system for supporting a frame of a mineral material crusher on a body of a crushing plant, the system comprising:

two first support devices configured to support the frame of the crusher on the body of the crushing plant at two first support points; and two second support devices configured to support the frame of the crusher on the body of the crushing plant at two second support points, wherein the second support points are located at a distance from the first support points, and wherein each of the second support devices has an adjusting member configured to be between the frame of the crusher and the body of the crushing plant and each of the adjusting members adjusts a vertical position of the second support points relative to each other to thereby reduce undesired twisting of the frame of the crusher;

wherein each adjusting member is a cylinder and a piston adapted inside the cylinder, a mechanically acting adjusting member, or an electromechanically acting adjusting member.

10. The system according to claim 9, wherein the piston and the cylinder define an adjusting volume therebetween in which a pressure is formed from a load acting on the adjusting member.

11. The system according to claim 9, wherein the piston and the cylinder of each adjusting member define an adjusting volume therebetween in which a pressure is formed from a load acting on the adjusting member, and wherein the system further comprises a hydraulic channel connected to the adjusting volumes and configured to permit a hydraulic liquid to flow between the adjusting volumes to thereby equalize the pressure in the adjusting volumes.

12. The system according to claim 11, wherein the hydraulic channel is a first hydraulic channel, and further comprising:

a pressure accumulator; and a second hydraulic channel;

wherein the first hydraulic channel has a first end connected to one of the adjusting volumes and a second end connected to the pressure accumulator and the second hydraulic channel has a first end connected to the other of the adjusting volumes and a second end connected to the pressure accumulator.

13. The system according to claim 9, wherein the first support devices are connected to a front end of the frame of the crusher and the second support devices are connected to a rear end of the frame of the crusher.

14. The system according to claim 9, wherein the second support devices are arranged to rest with a friction joint on the body of the crushing plant.

15. The system according to claim 11, wherein when the second support points are vertically offset relative to each other, so that hydraulic liquid flows from one of the adjusting volumes through the hydraulic channel to the other of the adjusting volumes, one of the adjusting members contracts and the other of the adjusting members expands to thereby vertically adjust the second support points relative to each other.

16. The system according to claim 9, wherein the crusher is one of the following: a jaw crusher, a horizontal shaft impactor, a vertical shaft impactor, a gyratory crusher, and a cone crusher.

17. A mineral material processing plant, wherein the mineral material processing plant comprises a system according to claim 9.

18. The system according to claim 12 further comprising a control unit operable to detect the pressure in each of the adjusting volumes and control the pressure accumulator based on the pressure in each of the adjusting volumes.

19. The method according to the claim 12 further comprising a control unit operable to detect a vertical ratio of the frame of the crusher and the body of the crushing plant and control the pressure accumulator based on the vertical ratio such that each adjusting volume has a desired volume and pressure and each adjusting member contracts or expands to adjust the vertical position of the frame of the crusher.

* * * * *